US005691066A

United States Patent [19]

Rajagopalan

[11] Patent Number: 5,691,066

[45] Date of Patent: Nov. 25, 1997

[54] GOLF BALL COMPRISING FLUOROPOLYMER AND METHOD OF MAKING SAME

[75] Inventor: Murali Rajagopalan, South Dartmouth, Mass.

[73] Assignee: Acushnet Company, Fairhaven, Mass.

[21] Appl. No.: 668,652

[22] Filed: Jun. 25, 1996

[51] Int. Cl.[6] ..... A63B 57/00; C08F 214/18; C08L 27/12; C08L 33/02

[52] U.S. Cl. ..... 428/421; 473/371; 473/372; 473/374; 473/377; 473/378; 473/385; 525/196; 525/199; 525/200; 525/221; 525/327.8; 525/330.2; 525/919; 526/243; 526/245; 526/247

[58] Field of Search ..... 428/421, 422; 473/351, 371, 374, 372, 376, 377, 378, 385; 525/191, 196, 199, 200, 201, 326.1, 327.8, 212, 221, 222, 330.2, 919; 526/242, 243, 245, 246, 247

[56] References Cited

U.S. PATENT DOCUMENTS

| | | | |
|---|---|---|---|
| 3,041,317 | 6/1962 | Gibbs et al. | 260/79.3 |
| 3,264,272 | 8/1966 | Rees | 260/78.5 |
| 3,282,875 | 11/1966 | Connolly et al. | 260/29.6 |
| 3,454,280 | 7/1969 | Harrison et al. | 273/235 |
| 3,624,053 | 11/1971 | Gibbs et al. | 260/79.3 |
| 3,819,768 | 6/1974 | Molitor | 260/897 B |
| 3,882,093 | 5/1975 | Cavanaugh et al. | 260/79.3 MU |
| 3,992,014 | 11/1976 | Retford | 273/218 |
| 4,323,247 | 4/1982 | Keches et al. | 273/235 R |
| 4,431,193 | 2/1984 | Nesbitt | 273/235 R |
| 4,486,319 | 12/1984 | Jamison | 252/12.2 |
| 4,508,309 | 4/1985 | Brown | 249/81 |
| 4,526,375 | 7/1985 | Nakade | 273/235 R |
| 4,674,751 | 6/1987 | Molitor | 273/235 R |
| 4,884,814 | 12/1989 | Sullivan | 273/235 R |
| 4,911,451 | 3/1990 | Sullivan et al. | 273/235 R |
| 5,197,740 | 3/1993 | Pocklington et al. | 273/235 R |
| 5,324,783 | 6/1994 | Sullivan | 525/196 |
| 5,409,233 | 4/1995 | Kennedy | 273/235 A |
| 5,625,003 | 4/1997 | Kato et al. | 525/208 |

*Primary Examiner*—Paul J. Thibodeau
*Assistant Examiner*—Vivian Chen
*Attorney, Agent, or Firm*—Pennie & Edmonds

[57] ABSTRACT

A golf ball having a covering or coating consisting in whole or in part of a sulfonated or carboxylated fluoropolymer wherein the fluoropolymer comprises 1–100% of the covering or coating. The fluoropolymer may be blended with conventional golf ball cover or coating materials. A method of enhancing the cut resistance, abrasion resistance, and durability of a golf ball comprises the steps of: a) forming a golf ball core; and b) forming a cover around said core by either compression molding preformed half-shells of cover stock material comprising of a sulfonated or carboxylated fluoropolymer about said core or by injection molding cover stock material comprising of a sulfonated or carboxylated fluoropolymer around said core. Another method of enhancing the cut resistance, abrasion resistance, and durability of a golf ball in accordance comprises coating the golf ball with a sulfonated or carboxylated fluoropolymer.

23 Claims, No Drawings

GOLF BALL COMPRISING FLUOROPOLYMER AND METHOD OF MAKING SAME

FIELD OF THE INVENTION

The invention relates to golf balls and, more particularly, to golf balls having covers, coatings or cores which comprise fluoropolymers and to methods for making the same. Golf balls produced in accordance with the present invention are characterized by improved properties including abrasion-resistance, cut resistance, and durability.

BACKGROUND OF THE INVENTION

Golf balls have undergone extensive evolution designed to improve their play-related characteristics, such as durability, distance, and control. Modern golf balls can be classified as one-piece, two-piece, and three-piece balls.

One-piece balls are formed from a homogeneous mass of material with a dimple pattern molded therein. One-piece balls are inexpensive and durable, but do not provide great distance because of relatively high spin and low velocity.

Two-piece balls are the most popular type of ball in use today. They comprise a cover molded around a solid core. Conventionally, both two-piece and three-piece golf balls are made by molding a cover about the ball core, either by injection-molding cover stock material around a core held in a retractable pin mold or by compression molding preformed half-shells about the core. The preformed half-shells are formed by injecting cover stock material into half-shell molds and solidifying the cover stock material into a corresponding shape.

Golf ball cores, whether wound or solid, typically measure from 1.4 to 1.6 inches (3.5 to 4.1 cm) in diameter. The cover is molded about the core to form a golf ball having the minimum United States Golf Association (USGA) specified diameter of 1.68 inches (4.3 cm). Typically, the cover has a thickness of about 0.060 inches. Two-piece balls typically have a hard "cutproof" cover which gives a longer distance ball, but which has lower spin rates, resulting in a decreased ability to control the ball.

Three-piece or wound balls are made by molding a cover about a wound center. The center is typically made of rubber and can be solid, semi-solid or fluid, e.g., liquid-filled. A wound center is prepared by winding a thin thread of elastic material about the center. The wound center is then covered with a durable cover material. Wound balls are generally softer and provide more spin, resulting in increased control over the ball, but such balls typically travel a shorter distance than that traveled by a two-piece ball. As a result of their more complex construction, wound balls generally are more expensive to produce than two-piece balls.

The covers of golf balls are generally made from a variety of materials, such as balata or ionomer resins such as SURLYN® and IOTEK®. Balata, which is a natural or synthetic trans-polyisoprene rubber, is the softest of these cover materials. Balata covered balls are favored by the more highly skilled golfers because the softness of the cover allows the player to achieve spin rates sufficient to more precisely control ball direction and distance, particularly on shorter shots.

However, balata covered balls are expensive and less durable as compared to the other covering materials. In particular, balata covered balls are subject to nicks or cuts as a result of a mis-swung golf club or due to landing on cart paths, etc. and/or contact with rocks, trees, etc. Such nicks or cuts detract from the flight characteristics of such balls, rendering them of little use. Accordingly, cover compositions have been developed in an attempt to provide balls with spin rates and a feel approaching those of balata covered balls, while also providing a golf ball with a higher durability and overall distance.

Ionomer resins have, to a large extent, replaced balata as a cover stock material. Chemically, ionomer resins are a copolymer of an olefin and an alpha, beta ethylenically-unsaturated carboxylic acid having 10–90% of the carboxylic acid groups neutralized by a metal ion. See U.S. Pat. No. 3,264,272. Commercially available ionomer resins include, for example, copolymers of ethylene and methacrylic or acrylic acid. These are sold by E.I. DuPont de Nemours and Co. under the trademark "SURLYN®" and by the Exxon Corporation under the trademark "ESCOR®" and the trademark "IOTEK®". These ionomer resins are distinguished by the type of metal ion, the amount of acid, and the degree of neutralization. Also, Chevron Chemical Co. sells a family of ionomers produced from ethylene acrylate-based copolymers under the trademark "TMAC®".

U.S. Pat. Nos. 3,454,280, 3,819,768, 4,323,247, 4,526,375, 4,884,814, and 4,911,451 all relate to the use of SURLYN®-type compositions in golf ball covers. However, while SURLYN® covered golf balls as described in the preceding patents possess virtually cutproof covers, they have inferior spin and feel properties as compared to balata covered balls.

In 1986, DuPont introduced two new classes of ionomer resins. One was a sodium and zinc ionomer resin having a low flexural modulus. DuPont suggested using and blending the same with other ionomer resins for making a golf ball cover. Golf ball covers made from these low flexural modulus ionomer resins have improved spin and feel characteristics but relatively low velocity. The other was a lithium ionomer resin which was a copolymer of ethylene and methacrylic acid. These lithium ionomer resins have a very high flexural modulus, typically about 60,000 psi (415 MPa). DuPont suggested that lithium ionomer resins could be used to produce a golf ball cover which would be more cut resistant and harder than a cover made with either sodium or zinc ionomer resins. DuPont also suggested that a golf ball having a cover made from a lithium ionomer resin would go farther, have a higher coefficient of restitution and be less prone to cutting (i.e., more durable) than a golf ball made from other known ionomer resins such as sodium and zinc ionomer resins and blends thereof. DuPont further suggested that lithium ionomer resins could be used in blends with other ionomer resins where they can impart better cut resistance to those other resins.

The USGA has promulgated a rule that no golf ball shall have an initial velocity that exceeds 255 feet (78 m) per second, i.e., 250 feet (76 m) per second with a 2% tolerance when impacted by the USGA test machine under specified conditions. Golf balls with covers made from ionomer resins with a low flexural modulus are woefully below this maximum and, as should be appreciated, all golf ball manufacturers strive to come as close as possible to this limit.

In various attempts to produce an ideal golf ball, the golfing industry has blended hard ionomer resins (i.e., those ionomer resins having a hardness of about 60 to about 70 on the Shore D scale as measured in accordance with ASTM method D-2240) with a number of softer polymeric materials, such as softer polyurethanes (see, e.g., U.S. Pat. No. 4,674,751 to Molitor et al.). However, the blends of the hard ionomer resins with the softer polymeric materials have generally been unsatisfactory in that these balls exhibit numerous processing problems. In addition, the balls produced by such a combination are usually short on distance.

In addition, various hard-soft ionomer blends, that is, mixtures of ionomer resins which are significantly different in hardness and/or flexural modulus, have been attempted. U.S. Pat. No. 4,884,814 discloses the blending of various hard methacrylic based ionomer resins with similar or larger quantities of one or more "soft" ionomer methacrylic acid based ionomer resins (i.e., those ionomer resins having a hardness from about 25 to 40 as measured on the Shore D scale) to produce relatively low modulus golf ball cover compositions that are not only softer than the prior art hard ionomer covers but also exhibit a sufficient degree of durability for repetitive play. These relatively low modulus cover compositions were generally comprised of from about 25 to 70% of hard ionomer resins and from about 30 to 75% of soft ionomer resins.

U.S. Pat. No. 5,324,783 discloses golf ball cover compositions comprising a blend of a relatively large amount, e.g., 70–90 wt. %, of hard ionomer resins with a relatively low amount, e.g., 10 to about 25–30 wt. %, of soft ionomers. The hard ionomers are sodium or zinc salts of a copolymer of an olefin having from 2 to 8 carbon atoms and an unsaturated monocarboxylic acid having from 3 to 8 carbon atoms. The soft ionomer is a sodium or a zinc salt of a terpolymer of an olefin having from 2 to 8 carbon atoms, methacrylic acid and an unsaturated monomer of the acrylate ester class having from 1 to 21 carbon atoms.

In order to approximate the characteristics of balata covered balls at lower cost, the art has developed balls having a variety of cover compositions. There are more than fifty commercial grades of ionomers available from DuPont and Exxon with a wide range of properties which vary according to the type and amount of metal cations, molecular weight, composition of the base resin (i.e., relative content of ethylene and methacrylic and/or acrylic acid groups) and additive ingredients such as reinforcements, etc. As noted above, these prior art compositions have a considerably higher cut resistance and durability as compared to balata covered balls. A great deal of research continues in order to develop golf ball cover compositions exhibiting not only improved impact resistance and carrying distance properties produced by the "hard" ionomeric resins, but also the playability (i.e. "spin") characteristics previously associated with the "soft" balata covers, properties which are still desired by the more skilled golfer.

Finishing coats of paints are often applied to the molded surface of the golf ball in order to obtain a desired whiteness for the ball and to protect logos and/or trademarks appearing on the surface of the golf ball cover materials. The abrasion and cut resistance of such coatings is typically adjusted by adding filler materials, by using a harder resin, that is, one having a higher glass transition temperature ($T_g$), by employing a slip and mar agent, and/or by increasing the crosslink density of the polymer.

U.S. Pat. No. 3,992,014 teaches that solid particulate filler materials, for instance 1–50% based on weight of rubber polymer, can be included in the formulation as needed or desired to impart specific properties to the molded article. For example, for golf ball applications, such filler materials as zinc oxide, magnesium oxide, silica, hydrated silica such as HiSil 233, carbon black, lithium oxide, and the like, can advantageously be used to improve the scratch and abrasion resistance of the composition. The '014 patent also teaches the inclusion of a silane in a homogeneous golf ball composition which is based on a cross-linked rubber polymer for the purpose of improving the velocity of such golf balls.

U.S. Pat. No. 4,486,319 teaches that the lower the Melt Flow Index of the coating polymer, the higher the abrasion resistance of the composition. The '319 patent also teaches that ionomers do have abrasion resistance, which makes them useful for such items as golf ball covers.

U.S. Pat. No. 5,197,740 teaches that Surlyn containing covers are highly advantageous in that the resulting covers are extremely resistant to cuts and abrasion. These balls are commonly referred to in golfing circles as cutless balls. However, the '740 patent also enumerates problems with the Surlyn balls: while extremely advantageous from the standpoint of cut resistance, the golf balls described in U.S. Pat. No. 3,454,280 have a shortcoming in that they do not have cold temperature cracking properties such as to permit their use at temperatures below freezing. In fact, when such balls are played at temperatures below freezing, they have a tendency to crack or explode when struck by a golf club. Likewise, balls produced according to the patent are lacking in their coefficient of restitution, a property related to the distance which a golf ball can be driven.

U.S. Pat. No. 5,409,233 teaches that coatings which are prepared using hexamethylene diisocyanate-based products show resistance to chemicals and abrasion. The '233 patent also teaches the use of mar and slip agents.

None of the prior art patents teach a solution to the continuing problem of providing a golf ball with an industry acceptable coating suitable for use under rigorous conditions. In view of the problem caused by the cutting, scratching, and abrasion of the covers of golf balls, there exists a need for golf ball covers and coatings that are capable of providing improved cut and abrasion resistance and adherence without adversely affecting overall golf ball performance characteristics.

Consequently, a need exists for a golf ball cover composition which provides spin rates and a feel more closely approximating those of balata covered balls, while also providing as high or a higher degree of durability than that provided by the balls presently available or disclosed in the prior art.

SUMMARY OF THE INVENTION

The invention is directed to a golf ball comprising a fluoropolymer. While the fluoropolymer will generally be used in forming some or all of the cover of the golf ball, it may also or alternatively comprise some or all of the core and/or the external coating of the golf ball. In accordance with the invention, the fluoropolymer comprises from 1 to 100% by weight of the cover of the golf ball.

More particularly, the present invention is directed to a golf ball cover or coating comprising a functionalized fluoropolymer resin, for instance a fluoropolymer resin that is sulfonated or carboxylated.

In one embodiment, the fluoropolymer for use in the invention has the formula

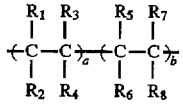

in which a is a number from 1 to 100, b is a number from 99 to 1, $R_1$–$R_7$ are independently selected from the group consisting of H, F, alkyl, and aryl, and $R_8$ is H, F, or a moiety of the formula $$\left(O-CF_2-\underset{}{\overset{CF_3}{\overset{|}{C}}}F\right)_m O-CF_2-CF_2-Z$$

in which m is a number from 1 to 18 and Z is selected from the group consisting of $SO_2F$, $SO_3F$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

In a further embodiment, the fluoropolymer described above may additionally include an optional third monomeric component having the formula $$\left(\underset{R_{10}}{\overset{R_9}{C}}-\underset{R_{12}}{\overset{R_{11}}{C}}\right)_c$$

in which c is a number from 1 to 50, $R_9$–$R_{11}$ are independently selected from the group consisting of H, F, alkyl and aryl, $R_{12}$ is selected from the group consisting of $$-\overset{O}{\overset{\|}{C}}-OR_{13},\ -\overset{O}{\overset{\|}{C}}-OH \text{ and } -\overset{O}{\overset{\|}{C}}-O^-M^+,$$

wherein $R_{13}$ is a $C_1$–$C_{12}$ linear or branched chain alkyl group.

In the golf ball cover or coating of the present invention, the fluoropolymer resin preferably comprises from 10 to 90% by weight of the cover while 90 to 10 weight-% of the cover is comprised of one or more conventional, non-fluorinated ionomeric and/or non-ionomeric thermoplastic polymers.

The invention includes one-piece golf balls comprising a fluoropolymer as well as two-piece and three-piece golf balls comprising at least one cover layer and a core, wherein at least one cover layer comprises a fluoropolymer, as well as golf balls that comprise cores or covers having two or more layers.

The present invention also provides a method of enhancing the cut and abrasion resistance of a golf ball. The method comprises the steps of forming a golf ball core by conventional means and subsequently forming a cover around the core by either compression molding preformed half-shells of cover stock material comprising a fluoropolymer about the core or by injection molding cover stock material comprising a fluoropolymer about the core. Golf balls that are manufactured in this manner will have cut and abrasion resistance superior to otherwise similar golf balls without fluoropolymer in their covers.

Further in accordance with the present invention, the fluoropolymer used to manufacture the golf ball may be blended with at least one additional thermoplastic ionomer and/or with at least one non-ionomeric thermoplastic resin.

The novel golf ball of the present invention offers improved mechanical properties in comparison to golf balls disclosed in the prior art, for instance, improved abrasion-resistance, cut-resistance, and durability. Further these balls may also provide enhanced distance (i.e., resilience) without adversely affecting, and in many instances while improving, their "playability" characteristics, i.e., their impact resistance, spin, "click" and "feel", compression, etc.

DESCRIPTION OF THE PREFERRED EMBODIMENTS

Broadly, the present invention contemplates a golf ball comprising a fluoropolymer. The ball may be a one-piece ball formed from a homogeneous mass consisting entirely of fluoropolymer, or including blends of conventional golf ball cover materials, such as those discussed hereinbelow, with fluoropolymers. One-piece balls will generally have a dimple pattern molded therein. One-piece balls in accordance with the present invention are quite durable, but do not provide great distance because of relatively high spin and low velocity.

A more preferred aspect of the present invention comprises two-piece and wound balls having covers comprising a functionalized fluoropolymer of the type disclosed herein.

The Fluoropolymers

A fluoropolymer is generally an olefinic polymer in which monomers containing units of the formula —(H)C=C(H)—, wherein one or more of the hydrogen atoms in the monomer is replaced by fluorine atoms, are reacted with identical monomers or more usually one or more different monomers to form a polymer. Preferably, the fluoropolymer is a perfluoropolymer. That is, all of the available hydrogens are replaced by fluorines. Also preferably, the fluoropolymer is functionalized. That is, the polymer contains reactive groups such as sulfonyl groups or carboxyl groups, in a degree sufficient to affect the properties of the polymer.

In accordance with the present invention, the fluoropolymer preferably has the formula $$\left(\underset{R_2}{\overset{R_1}{C}}-\underset{R_4}{\overset{R_3}{C}}\right)_a\left(\underset{R_6}{\overset{R_5}{C}}-\underset{R_8}{\overset{R_7}{C}}\right)_b$$

in which a is a number from 1 to 100, b is a number from 99 to 1, $R_1$–$R_7$ are independently selected from the group consisting of H, F, alkyl (preferably $C_1$–$C_4$ alkyl), and aryl, and $R_8$ is H, F, or a moiety of the formula $$\left(O-CF_2-\overset{CF_3}{\overset{|}{C}}F\right)_m O-CF_2-CF_2-Z$$

in which m is a number from 1 to 18 and Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

In an alternate preferred embodiment, the fluoropolymer for use with the invention can be a terpolymer having the formula $$\left(\underset{R_2}{\overset{R_1}{C}}-\underset{R_4}{\overset{R_3}{C}}\right)_a\left(\underset{R_6}{\overset{R_5}{C}}-\underset{R_8}{\overset{R_7}{C}}\right)_b\left(\underset{R_{10}}{\overset{R_9}{C}}-\underset{R_{12}}{\overset{R_{11}}{C}}\right)_c$$

where a, b and $R_1$–$R_8$ are as defined above, C is a number from 1 to 50, $R_9$–$R_{11}$ are independently selected from the group consisting of H, F, alkyl and aryl, $R_{12}$ is selected from the group consisting of $$-\overset{O}{\overset{\|}{C}}-OR_{13},\ -\overset{O}{\overset{\|}{C}}-OH \text{ and } -\overset{O}{\overset{\|}{C}}-O^-M^+,$$

wherein $R_{13}$ is a $C_1$–$C_{12}$ linear or branched chain alkyl group.

More preferably, the fluoropolymer used in the invention has the formula

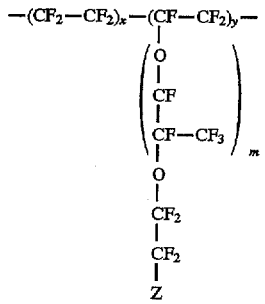

wherein Z is as defined above, x is 1–100, y is 99 to 1, and m is a number from 1 to 12, more preferably from 7 to 10.

Such fluoropolymers may be prepared by copolymerizing a compound of the structure $$CF_2{=}CFOCF_2CF(CF_3)OCF_2CF_2Z$$

or, more broadly, vinyl ethers of the structures $$CF_2{=}CF(X)_nOCF_2CFRZ$$

and/or $$CF_2{=}CF(X)_nOCF(Z)CF_2R$$

wherein X is $O(CF_2)_{2-10}$, $OCF_2CFY$, or $OCFYCF_2$, Y is F or $CF_3$, and Z is as defined above. In these formulas, R is F or a perfluoroalkyl group having up to 10 carbon atoms, and n is 0, 1, or 2. These vinyl ethers are copolymerized with perfluoroethylene and/or perfluoro-α-olefins. Such polymers are useful in molecular weights ranging from 1000 to 500,000. Such polymers are disclosed in U.S. Pat. Nos. 3,041,317, 3,282,875, and 3,624,053, the disclosures of which are expressly incorporated by reference herein. Some of the sulfonated polymers are commercially available from DuPont under the trademark NAFION®.

Other polymers which may be used according to the present invention include polymers containing molecular units of the structure $$-CF_2CF(X)_nOCF_2CFRZ \text{ or } -CF_2CF(X)_nOCF(CF_2R)Z$$

wherein X, Z, R, and n are as defined above. Such polymers may be prepared by polymerizing the vinyl ethers described above, optionally in a perfluorocarbon solvent, using a perfluorinated free radical initiator such as perfluoroperoxide or a nitrogen fluoride. It is also possible to polymerize the vinyl ethers in aqueous medium using a peroxide or a redox initiator. Preparations of these fluoropolymers are disclosed in U.S. Pat. Nos. 3,282,875 and 3,882,093, also incorporated herein by reference thereto.

Another preferred group of fluoropolymers for use in accordance with the present invention is those of the formula $$-(OCF_2CF(CF_3))_mOCF_2CF_2Z$$

wherein Z is as defined above and m is a number from 7 to 10. Fluoropolymers in which m is from 7 to 10 provide golf ball covers with greater resiliency and therefore better distance characteristics.

The fluoropolymers of the present invention can be synthesized by a variety of methods since it is well known in the art of polymer synthesis that many different synthetic protocols can be used to prepare a given compound. Different routes can involve more or less expensive reagents, easier or more difficult separation or purification procedures, straightforward or cumbersome scale-up, and higher or lower yield. The skilled synthetic organic polymer chemist knows well how to balance the competing characteristics of synthetic strategies. Thus the compounds of the present invention are not limited by the choice of synthetic strategy, and any synthetic strategy that yields the compounds described above can be used. However, since such polymers are commercially available, for instance from DuPont under the trademark NAFION® as discussed above, there will often be no need to synthesize them.

Cover Blends

In accordance with the present invention, the fluoropolymer comprises from 1 to 100% by weight of the golf ball cover. More usually, the fluoropolymer comprises from 10 to 90% of the cover and 90 to 10% of the cover is comprised of one or more conventional non-fluorinated thermoplastic polymers, such as the SURLYN®, ESCOR®, IOTEK®, and IMAC® copolymers described above.

In a further embodiment of the present invention the polymers of the subject invention are combined with other thermoplastic polymer resins lacking ionomeric character. Polymers which can be used in conjunction with the polymers of the claimed invention in golf ball covers include: poly(ethylethylene), poly(heptylethylene), poly(hexyldecylethylene), poly(isopentylethylene), poly(1,1-dimethyltrimethylene), poly(1,1,2-trimethyltrimethylene), poly(butyl acrylate), poly(4-cyanobutyl acrylate), poly(2-ethylbutyl acrylate), poly(heptyl acrylate), poly(2-methylbutyl acrylate), poly(3-methylbutyl acrylate), poly(N-octadecylacrylamide), poly(octadecyl methacrylate), poly(butoxyethylene), poly(methoxyethylene), poly(pentyloxyethylene), poly(1,1-dichloroethylene), poly(cyclopentylacetoxyethylene), poly(4-dodecylstyrene), poly(4-tetradecylstyrene), poly(oxyethylethylene), poly(oxytetramethylene), poly(oxytrimethylene), poly(oxycarbonylpentamethylene), poly(oxycarbonyl-3-methylpentamethylene), poly(oxycarbonyl-1,5-dimethylpentamethylene), poly(silanes), poly(silazanes), poly(furan tetracarboxylic acid diimides), and poly(vinylidene fluoride), as well as the classes of polymers to which they belong.

More preferably, the other polymers which can be combined with the polymers of the claimed invention in forming golf ball covers include: block poly(ether-ester) copolymers, such as HYTREL® available from DuPont, block poly(ether-amide) copolymers, such as PEBAX® available from Elf Atochem, styrene-butadiene-styrene block copolymers, such as the KRATON De grades available from Shell Chemical, styrene-(ethylene-propylene)-styrene or styrene-(ethylene-butylene) -styrene block copolymers, such as the KRATON G® series from Shell Chemical, either of the KRATON®-type copolymers with maleic anhydride or sulfonic graft or functionality, such as the KRATON FD® or KRATON FG® series available from Shell Chemical, olefinic copolymers, such as the ethylene-methyl acrylate or ethylene-butyl acrylate series available from Quantum Chemical, ethylene-octene copolymers made from metallocene catalysts, such as the AFFINITY® or ENGAGE® series available from Dow, ethylene-alpha olefin copolymers and terpolymers made from metallocene catalysts, such as the EXACT® series available from Exxon, block poly (urethane-ester) or block poly(urethane-ether) or block poly (urethane-caprolactone), such as the ESTANE® series available from BF Goodrich, polyethylene glycol, such as CARBOWAX® available from Union Carbide, polycaprolactone, polycaprolactam, polyesters, such as EKTAR® available from Eastman, polyamides, such as nylon 6 or nylon 6,6, available from DuPont and ICI, ethylene-propylene-(diene monomer) terpolymers and their sulfonated or carboxylated derivatives, and SANTOPRENE® from Monsanto.

The polymer blends of this invention can be prepared with or without the addition of a compatibilizer and with varying molecular architecture of blend components, such as varying molecular weight, tacticity, degrees of blockiness, etc., as is well known to those knowledgeable in the art of blending polymers.

Preferably, the cover stock used to make a golf ball cover in accordance with the present invention is a blend of the polymers of the present invention and another cover material. Blending of the ionomer resins is accomplished in a conventional manner using conventional equipment. Good results have been obtained by mixing the comonomers or resins in a solid, pelletized form and then placing the mix into a hopper which is used to feed the heated barrel of an injection molding machine. Further mixing is accomplished by a screw in the heated barrel. The injection molding machine is used either to make preformed half-shells for compression molding about a core or for molding flowable cover stock about a core using a retractable-pin mold. Such machines are conventional.

Additional components which can be added to the golf ball compositions of the present invention include U.V. stabilizers such as TINUVIN™ 213 and TINUVIN™ 328, for example. Also, light stabilizers such as, for example, TINUVIN™ 770 and TINUVIN™ 765, may also be used. TINUVIN™ products are available from Ciba-Geigy. Other dyes, as well as optical brighteners and fluorescent pigments and dyes may also be used in the golf ball covers produced with polymers formed according to the present invention. Such additional ingredients may be used in any amounts that will achieve their desired purpose. However conventional amounts include the range of from about 0.05% to about 1.5%, or more preferably, from about 0.5% to about 1.0%.

Effective amounts of white pigment and violet agent can be added to the cover composition. Suitable violet agents include PV Fast Violet RL Special and Hostapern Violet RL Extra Strong sold by Hoechst Celanese Corporation; and Violet 23 sold by Sun Chemical Corporation. The amount of violet agent added to the cover composition is preferably about 0.0005% to about 0.002% based on total weight of cover stock. Good results have been obtained with about 0.001% by weight. Preferably, about 3.5% of the white pigment by weight of the total cover composition is used in the cover stock of the present invention.

Ultramarine blue pigments may also be used in golf ball covers formed according to the present invention. Preferably the amount of ultra marine blue pigment used will range from about 0.01% to about 1.0% or more preferably from about 0.4% to about 0.8%.

Suitable white pigments include titanium dioxide, calcium carbonate, zinc oxide and zinc sulfide. These white pigments may be used in any amount which is suitable to provide a uniform white color of the desired brightness to the golf ball covers of the present invention. In particular, these white pigments may be incorporated in amounts of from about 0.001% to about 5.0%. The more preferred range of white pigment is from about 0.2% to about 0.4%.

Other conventional ingredients, e.g., fillers are well known to the person of ordinary skill in the art and may be included in the present invention in amounts effective to achieve their known purpose.

An optional filler component may be chosen to impart additional density to blends of the previously described components. The selection of such filler(s) is dependent upon the type of golf ball desired (i.e., one-piece, two-piece or three-piece), as will be more fully detailed below. Generally, the filler will be inorganic, having a density greater than about 4 g/cc, preferably greater than 5 g/cc, and will be present in amounts between 5 and 65 weight percent based on the total weight of the polymer components. Examples of useful fillers include zinc oxide, barium sulfate, lead silicate and tungsten carbide, as well as the other well known corresponding salts and oxides thereof. It is preferred that the filler components be non-reactive with the polymer components described above.

Additional optional additives useful in forming the golf balls of the present invention include acid copolymer waxes (e.g., Allied wax AC143 believed to be an ethylene/16–18% acrylic acid copolymer with a number average molecular weight of 2,040) which assist in preventing reaction between the filler materials (e.g., ZnO) and any acid moiety in the polymer; optical brighteners; surfactants; processing aids; etc.

The present polymers may be blended with any of the additional ingredients noted above, for example, to be used in a golf ball cover using any conventional blending technique. For example, the present compounds may be added to a vessel containing pelletized polymer resins and heated to 300° F.–500° F. Thorough mixing of the materials is accomplished by means of a screw in the heated vessel.

Golf Ball Manufacture

The polymers of the invention can be used to form any type of golf ball. In particular, two-piece golf balls comprising a cover surrounding a core are within the scope of the present invention, as are wound golf balls, in which a liquid, semi-solid, or solid core is surrounded by an elastic synthetic material. The term "solid cores" as used herein refers not only to one piece cores but also to those cores having a separate solid layer beneath the cover and above the core as disclosed in U.S. Pat. No. 4,431,193 (the disclosure of which is incorporated herein), and other multilayer and/or non-wound cores. Any type of golf ball core can be used in the golf balls of the present invention. Preferred cores, however, include some amount of cis-butadiene. The subject polymers may also be used in golf balls having multiple covers and/or multiple cores.

Typically, the covers are formed around the solid or wound cores by either compression molding preformed half-shells of the cover stock material or by injection molding the cover stock about the core. Half-shells are made by injection molding a cover stock into a conventional half-shell mold in a conventional manner. The preferred method is compression molding of preformed half-shells.

In compression molding, the half-shells of the stock material are formed by injection molding the cover stock material into a conventional half-shell mold at 300° F.–520° F. for a short time. The preformed half-shells are then placed about a core and the assembly is introduced into a compression molding machine. The compression molding machine is a hydraulic press having an upper and lower mold plate.

As taught by U.S. Pat. No. 4,508,309, such mold plates have half molds, each of which is registered with another half mold in the opposite mold plate. It has been found that a golf ball is formed with a cover in accordance with the present invention when the half-shells are compression molded about a core at about 250° to 400° F. The molded balls are then cooled while still in the mold and finally removed when the cover is hard enough to be handled without deforming.

Alternatively, golf balls can be covered solely with the use of an injection molding technique utilizing an injection molding machine in which the core assembly is placed in a mold cavity. The core assembly is held in place through the use of several retractable pins. Such injection molding machines are well known in the art. The molten cover material is injected into the cavity surrounding the core. As the cover material cools and hardens, the pins retract and the molded ball is ejected from the mold. The balls then undergo conventional finishing operations such as buffing, painting and stamping. This type of cover construction is generally referred to as a one-piece cover.

The present invention can be used in forming golf balls of any desired size. While USGA specifications limit the size of a competition golf ball to more than 1.680 inches in diameter, golf balls of any size can be used for leisure golf play. The preferred diameter of the golf balls is from about 1.680 inches to about 1.800 inches. The more preferred diameter is from about 1.680 inches to about 1.760 inches. A diameter of from about 1.680 inches to about 1.740 inches is most preferred, however diameters anywhere in the range of from 1.70 to about 1.95 inches can be used. Oversize golf balls with diameters above about 1.760 inches to as big as 2.75 inches are also within the scope of the present invention.

All patents cited in the foregoing text are expressly incorporated herein by reference in their entirety.

It will be understood that the claims are intended to cover all changes and modifications of the preferred embodiments of the invention, herein chosen for the purpose of illustration, which do not constitute a departure from the spirit and scope of the invention.

What is claimed is:

1. A golf ball having an outer surface wherein the improvement comprises forming at least said outer surface of a thermoplastic material comprising at least one functionalized fluoropolymer, wherein said fluoropolymer has the formula

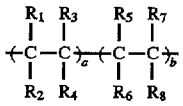

in which a is a number from 1 to 100; b is a number from 99 to 1; $R_1$–$R_7$ are independently selected from the group consisting of H, F, alkyl, and aryl; and $R_8$ is H, F, or a moiety of the formula

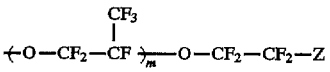

in which m is a number from 1 to 18; and Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

2. The golf ball of-any claim 1 wherein said outer surface is comprised of up to about 100 wt % of said functionalized fluoropolymer.

3. A golf ball having at least an outer surface formed of a material selected from the group consisting of thermoplastic materials and thermosetting materials, wherein the improvement comprises applying upon said outer surface at least one layer of a coating material, said coating material comprising at least one functionalized fluoropolymer, wherein said fluoropolymer has the formula

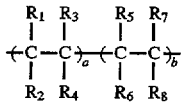

in which a is a number from 1 to 100; b is a number from 99 to 1; $R_1$–$R_7$ are independently selected from the group consisting of H, F, alkyl, and aryl; and $R_8$ is H, F, or a moiety of the formula

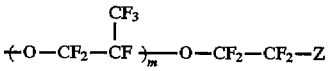

in which m is a number from 1 to 18: and Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

4. The golf ball of claim 3 wherein said coating material is comprised of up to about 100 wt % of said functionalized fluoropolymer.

5. A golf ball having an outer surface, said golf ball having at least one coating layer deposited upon said outer surface, said outer surface formed of a material selected from the group consisting of thermoplastic materials and thermosetting materials, wherein at least said outer surface and said coating layer comprise at least one functionalized fluoropolymer, wherein said fluoropolymer has the formula

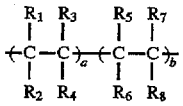

in which a is a number from 1 to 100; b is a number from 99 to 1; $R_1$–$R_7$ are independently selected from the group consisting of H, F, alkyl, and aryl; and $R_8$ is H, F, or a moiety of the formula

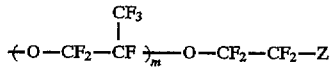

in which m is a number from 1 to 18; and Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

6. The golf ball of any one of claims 1, 3 or 5 wherein said fluoropolymer is a terpolymer having the formula

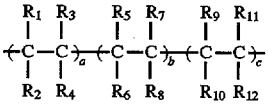

wherein C is a number from 1 to 50; $R_9$–$R_{11}$ are independently selected from the group consisting of H, F, alkyl and aryl; and $R_{12}$ is selected from the group consisting of $$-\overset{O}{\overset{\|}{C}}-OR_{13},\ -\overset{O}{\overset{\|}{C}}-OH \text{ and } -\overset{O}{\overset{\|}{C}}-O^{-}M^{+},$$

wherein $R_{13}$ is a $C_1$–$C_{12}$ linear or branched chain alkyl group.

7. The golf ball of any claims 1, 3 or 5 wherein said fluoropolymer has the formula $$-(CF_2-CF_2)_x-(CF-CF_2)_y-$$

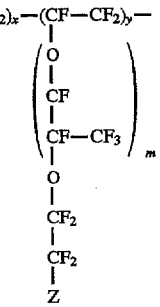

wherein m is 1–12; x is 1–100; y is 99 to 1; and Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

8. The golf ball of claim 7 wherein m is a number from 7 to 10.

9. The golf ball of any one of claim 7 wherein said fluoropolymer is formed by copolymerizing a vinyl ether having a structure selected from the group consisting of $CF_2{=}CFOCF_2CF(CF_3)OCF_2CF_2Z$;

$CF_2{=}CF(X)_nOCF_2CFRZ$; and $CF_2{=}CF(X)_nOCF(Z)CF_2R$ wherein X is $O(CF_2)_{2-10}$, $OCF_2CFY$, or $OCFYCF_2$, with Y=F or $CF_3$; Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb and transition elements; R is F or a perfluoroalkyl group having up to 10 carbon atoms; and n is 0, 11, or 2.

10. The golf ball of any one of claims 1, 3 or 5 wherein said fluoropolymer has molecular units selected from the group consisting of $$-\overset{|}{CF_2CF(X)_nOCF_2CFRZ};\ -\overset{|}{CF_2CF(X)_nOCF}\underset{CF_2R}{|}Z\ ;\text{ and}$$

$$-(OCF_2CF(CF_3))_m-OCF_2CF_2Z$$

wherein X is $O(CF_2)_{2-10}$, $OCF_2CFY$ or $OCFYCF_2$; Z is selected from the group consisting of $SO_2F$, $SO_3H$, $SO_3^-M^{v+}$, COF, $CO_2H$, and $CO_2^-M^{v+}$, wherein v is the valence of M and M is a cation selected for the group I, Ia, IIa, IIb, IIIa, IIIb, IVa, IVb and transition elements; R is F or a perfluoroalkyl group having up to 10 carbon atoms; n is 0, 1 or 2; and m is 7–10.

11. The golf ball of any one of claims 1, 3 or 5 wherein said fluoropolymer is a perfluoropolymer that is sulfonated or carboxylated.

12. The golf ball of claim 1 or 5 wherein said fluoropolymer comprises from about 10 to about 90% of at least said outer surface and wherein about 90 to about 10% of said outer surface is comprised of one or more non-fluorinated thermoplastic polymers selected from the group consisting of ionomeric polymers, non-ionomeric polymers, and mixtures thereof.

13. The golf ball of claim 1 or 5 wherein said ball comprises at least one cover layer and a core, and wherein said outer surface comprises said cover layer.

14. The golf ball of claim 13 comprising a core having two or more layers.

15. The golf ball of claim 13 wherein said fluoropolymer is blended with at least one additional thermoplastic ionomer.

16. The golf ball of claim 13 wherein said fluoropolymer is blended with at least one non-ionomeric thermoplastic resin.

17. The golf ball of claim 3 or 5 wherein said fluoropolymer comprises from about 10 to about 90% of said coating and wherein about 90 to about 10% of said coating is comprised of one or more non-fluorinated thermoplastic polymers selected from the group consisting of ionomeric polymers, non-ionomeric polymers, and mixtures thereof.

18. A method of enhancing the cut and abrasion resistance of a golf ball comprising the steps of:

a) forming a golf ball core; and b) forming a cover around said core by molding a cover stock material comprising a fluoropolymer about said core, wherein said fluoropolymer has the formula

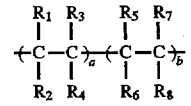

in which a is a number from 1 to 100; b is a number from 99 to 1; $R_1$–$R_7$ are independently selected from the group consisting of H, F, alkyl, and aryl; and $R_8$ is H, F, or a moiety of the formula

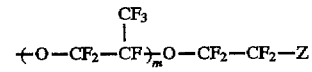

in which m is a number from 1 to 18; and Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

19. The method of claim 18 which further comprises choosing a cover stock material comprising a fluoropolymer having the formula

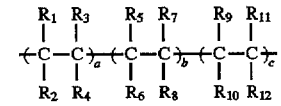

wherein c is a number form 1 to 50; $R_9$–$R_{11}$ are independently selected from the group consisting of H, F, alkyl and aryl; and $R_{12}$ is selected from the group consisting of $$-\overset{O}{\overset{\|}{C}}-OR_{13},\ -\overset{O}{\overset{\|}{C}}-OH \text{ and } -\overset{O}{\overset{\|}{C}}-O^{-}M^{+},$$

wherein $R_{13}$ is a $C_1$–$C_{12}$ linear or branched chain alkyl group.

20. The method of claim 18, wherein said fluoropolymer is selected from the group consisting of perfluoropolymers that are sulfonated or carboxylated and their salts.

21. The method of claim 20, wherein said cover material comprises from about 10 to about 90% of said fluoropolymer and wherein from about 90 to about 10% of the cover material is comprised of one or more non-fluorinated thermoplastic polymers selected from the group consisting of ionomeric polymers, non-ionomeric polymers and mixtures thereof.

22. A method of enhancing the cut resistance, abrasion resistance, and durability of a golf ball which comprises forming a golf ball and applying to the golf ball a coating composition comprising a fluoropolymer, wherein said fluoropolymer has the formula

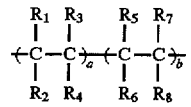

in which a is a number from 1 to 100; b is a number from 99 to 1; $R_1$–$R_7$ are independently selected from the group consisting of H, F, alkyl, and aryl; and $R_8$ is H, F, or a moiety of the formula

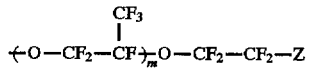

in which m is a number from 1 to 18: and Z is selected from the group consisting of $SO_2F$, $SO_3H$, $SO_3^-M^{v+}$, COF, $CO_2H$, and $CO_2^-M^{v+}$, wherein v is the valence of M and M is a cation selected from Group I, Ia, IIa, IIb, IIIa, IIIb, IVa, IVb, and transition elements.

23. The method of claim 22 which further comprises applying to said golf ball a coating composition comprising a fluoropolymer having the formula

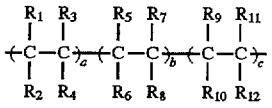

wherein c is a number form 1 to 50; $R_9$–$R_{11}$ are independently selected from the group consisting of H, F, alkyl and aryl; and $R_{12}$ is selected from the group consisting of

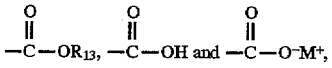

wherein $R_{13}$ is a $C_1$–$C_{12}$ linear or branched chain alkyl group.

* * * * *